US006022087A

United States Patent [19]

Gilbert

[11] Patent Number: 6,022,087

[45] Date of Patent: Feb. 8, 2000

[54] COMPUTER FURNITURE

[76] Inventor: David Gilbert, The Old Cottage, North Common Rd, Sussex RH17 7RJ, United Kingdom

[21] Appl. No.: 09/059,715

[22] Filed: Apr. 13, 1998

[51] Int. Cl.[7] ..... A47B 81/00

[52] U.S. Cl. ..... 312/194; 312/204; 312/223.2; 312/223.3; 361/683; 361/724

[58] Field of Search ..... 312/194, 223.2, 312/223.3, 204, 290, 208.1; 361/608, 616, 683, 685, 724, 725, 726, 727

[56] References Cited

U.S. PATENT DOCUMENTS

| | | | |
|---|---|---|---|
| 4,614,383 | 9/1986 | Polley et al. . | |
| 4,669,789 | 6/1987 | Pembertom | 312/223.3 |
| 4,766,422 | 8/1988 | Wolters et al. | 312/223.3 X |
| 5,242,217 | 9/1993 | Gonnet | 312/194 |
| 5,452,950 | 9/1995 | Crenshaw et al. | 312/223.3 |
| 5,558,418 | 9/1996 | Lambright et al. | 312/223.3 X |
| 5,587,877 | 12/1996 | Ryan et al. | 361/683 |
| 5,611,608 | 3/1997 | Clausen | 312/223.3 |
| 5,651,594 | 7/1997 | Lechman | 312/223.3 X |
| 5,743,603 | 4/1998 | Kelley et al. | 312/223.3 X |

*Primary Examiner*—Peter M. Cuomo
*Assistant Examiner*—Hanh V. Tran
*Attorney, Agent, or Firm*—Gunn & Associates P.C.

[57] ABSTRACT

Furniture for containing computer equipment is disclosed, where the computer equipment can be concealed when not in use. The furniture is in the form of a desk or table which has at least one normal drawer and at least one false drawer front which can be moved relative to or removed from the furniture (desk, credenza and so on). Computer equipment is mounted in the furniture carcass. When the equipment is in use, the false front is pivoted downward or removed, thereby exposing the equipment for easy access, for example via the disc ports. When not in use, the false drawer is positioned vertically and is fabricated to match the front of the normal drawer in appearance.

31 Claims, 9 Drawing Sheets

COMPUTER FURNITURE

The present invention relates to furniture which contains the central processing unit (CPU) of a computer.

The heart of a computer is the CPU (central processing unit—commonly a single integrated circuit), normally together with any closely associated circuit components and devices not requiring direct external access, such as memory, a power supply (CSU), and/or fan. There will also be some form of external signal coupling to and from the CPU. For example, a manual input, as via a mouse, keyboard or touch sensitive pad, and/or an electric signal input such as from a disc, CD ROM, telephone line, network connection and/or scanner, may be required. Outputs from the CPU may be required to be coupled, for example, to a display, a printer, network and/or telephone. A power source will also be necessary. Although signal and power coupling is common via hard electrical wire(s), other forms of coupling, e.g. optical or magnetic, are possible.

By the term "computer unit" is meant an integral arrangement which comprises a CPU (central processing unit—commonly a single integrated circuit) and closely associated circuits/circuit components, together with external access means for coupling the CPU to the exterior of the unit.

The degree of integration of signal input and output devices with a CPU to form a computer unit is variable. Typically, separate external signal input devices such as keyboards and mouse(s), and signal output devices such as displays and printers are plugged into a computer unit, although they could be hard wired therein as part of the computer unit. Other signal input/output devices, such as modems, floppy disc drives and CD ROM drives can also be external of the computer unit and coupled thereto, but are more commonly part of the computer unit and hard wired therein. Hard disc drives are almost invariably hard wired within the computer unit. Circuit components and devices not requiring direct external access, such as memory, a power supply, fan, are also normally hard wired within the computer unit.

Thus the external access means of a computer unit can range from a physical input/output means of a device which is coupled to the CPU and forms part of the computer unit, e.g. a slot for a floppy or hard disc or CD ROM, a touch pad, or a keyboard, to a connector (for example, as part of a plug and socket electrical connector, or an optical or magnetic transceiver) for an input/output device external of the computer unit.

It is common practice for all the parts of a computer unit to be mounted in a single steel case (often in the form of a "base unit"), to provide physical integrity. Many of the items within the casing of such a computer unit are commonly mounted on a motherboard which provides connections therebetween, while other connections (e.g. to disc drive, modem) are by discrete wires, for example. The combination of a "computer unit" with externally coupled devices will be referred to as a "computer system".

The visibility and portability of normal computer units and computer systems, and the accessibility of the CPUs and memory therewithin, make that relatively easy. The normal steel case is functional rather than aesthetic.

Computer systems have become a common feature in many environments, including the majority of offices and many homes. The need to couple various external units to a computer unit to form what is, essentially, a single computer system almost inevitably leads to a tangle of wires, which is undesirable and not aesthetically pleasing. It becomes difficult to check and alter or replace connections between the different units, reliability and speed of operation of the system could be reduced, and when the wires trail over the floor, personal safety considerations come into play, together with the risk of damage to the wires themselves.

It is known to provide computer desks which have oversized holes to accommodate a variety of cased computer units and printers, and work stations which are capable of holding a monitor, printer and cased computer unit—although if the latter is a tower unit it will often have to stand beside the desk or work station. The different complete units in their own cases are simply placed at their respective locations and interconnected. Removal is correspondingly simple. At least some parts of the interconnecting wiring and/or the units in their cases are commonly externally visible.

It is also known to provide furniture which is adapted to accommodate parts of a computer system in a more integral fashion. European Patent Application No. 0 165 130 discloses a two pedestal desk in which (a) a CRT monitor is retractable into one pedestal through an aperture in the desk top, which aperture is then closed flush with the desk top; (b) a keyboard on a central shelf is concealed when not in use by a sliding shutter which then lies flush with, and locally completes, the desk top—the shutter terminates in a vertical hinged flap, and both flap and shutter are necessary to conceal the keyboard; (c) a printer is located within the other pedestal, with continuous paper from a basket beneath the pedestal entering the back of the pedestal and emerging through a slot in the desk top; (d) also within the other pedestal is an assembly (computer unit) comprising, inter alia, a CPU, memory, power supply unit(s), disc drives and a fan. As shown, it appears that this assembly is formed on an open side drawer-like base which can be removed as an entity from the desk. Also as shown, the controls for movement of the monitor and the slots for the disc drives are always visible at the front of the respective pedestals, and the integrity of the desk top is destroyed by the apertures for paper and monitor. Even when it is not in use, it will be apparent that this is rather more than a simple desk.

U.S. Pat. No. 5,033,804 shows a computer desk in which the central portion of the top contains a concealable keyboard and flush monitor. This portion is located in a central box also containing a computer and power supply, and is rotatable relative to the box from a position flush with side portions of the worktop to a working position in which both monitor and keyboard are revealed. Other appliances such as a facsimile machine, copier and/or printer are located beneath doors in the side portions of the worktop. In this arrangement, the integrity of the desk top is destroyed both by the need to rotate the central portion and the need to access different appliances mounted below it, and it appears that the computer is a discrete (cased) unit. It also seems likely that the central box will be of a depth unusual in a simple desk.

Other computer desks are described in United Kingdom Patent Application Ser. No. 2 281 692, International Patent Application Ser. No. WO/86/06575, U.S. Pat. No. 4,852,500 and U.S. Pat. No. 5,071,204. In each of these, the work top lacks integrity, and/or external computer controls remain visible, and/or they do not disguise the fact that they contain a computer system, and/or they do not disguise the fact that a computer unit is incorporated, and is thus easily removable, as an entire unit.

European Patent Application No. 0 251 643 discloses a chair in which at least one arm incorporates an ergonomically designed keyboard which remains visible when not in use.

From a first aspect, the invention provides an item of furniture which comprises at least one drawer, and which has mounted within it a CPU and external access means for coupling to the exterior of the furniture, wherein said external access means is concealable by a movable or removable false drawer front. The false front would normally match the front of the one drawer. e.g. as regards design and/or width and/or height.

The access means so concealed could be means fixed to a static part of the furniture, for example, the access slots for disc drives, electrical, optical or other signal connectors, e.g. for a keyboard or display; or a connector for a power supply or display.

Alternatively, the false front may be mounted on, and movable or removable with respect to, a sliding shelf, so as to provide operating access to (for example) a keyboard on the shelf. In the preferred embodiment, a desk, when such a sliding shelf with keyboard is pushed into the desk, only the edge of the shelf and keyboard remain unconcealed by the body of the desk, and it is manipulation of the false front alone which serves to complete concealment of the keyboard within the desk.

The item of furniture could be a separate piece, such as bureau, chest of drawers, filing cabinet, but in one preferred form it is a desk or table (e.g. a writing table). In respect to the first and third aspects it could even be a bed, a chair, or a musical instrument such as a piano. Alternatively, the furniture could be built-in, as in a boat. Preferably, the furniture comprises a continuous (unbroken) work surface.

Preferably, the only case of the computer unit (or for the CPU) is that provided by the furniture. There is then no cased "computer unit" in the normal sense of the term, which can be removed as a single entity, as there is in known computer desks/work stations in use. Rather, different components of the computer unit are actually assembled as individual items onto the item of furniture, and are wholly contained and protected by the furniture.

Assembly of the different parts may be onto a part of the furniture which would be provided anyway (such as a shelf), but it is also possible to provide the furniture with an element provided for this purpose (for example a plate or a base of an open box) which is fixed within the furniture at some stage, and onto which the different parts are assembled.

By assembling the different components of the computer or computer system onto the furniture, repair or modification of any individual component can be facilitated, insofar as the normal outer metal casing does not require removal. As herein exemplified, the item of furniture may be appropriately modified to enable quick and easy access to the different components.

Preferably it is arranged so that all external access to the CPU contained therein, with the optional exception of a power supply cable, is concealed or concealable when the computer unit is not in use.

The item of furniture may be of any material, but is preferably of wood, or a "wood substitute" such a chipboard or fiberboard.

In most common applications, it will be convenient to couple an electrical power source by external hard wire to the furniture, although other means of providing electrical energy are known. Some other types of input and output, such as telephone (remote location), network (remote location), and display (adjacent location), will also conveniently be externally hard wired, although other ways of coupling these are possible. Preferably, but not necessarily, a composite single cable will be provided to accommodate a plurality for such external hard wired connections to remote locations.

Hard wire connection(s) to the furniture, particularly those for remote locations, can sometimes be concealed, as by extending through a hollow leg or to the base of a pedestal (it could even be possible to provide a connector at the base of the furniture for direct coupling to a complementary floor connector, provided the furniture is to be maintained in one position). Alternatively, a connector could be mounted in the furniture, for use with a complementary trailing power connector, preferably in a place not normally visible, or which can be concealed, as by a false drawer front (this could be sited at the back of a desk top, in conjunction with other drawers/false fronts). Or a small aperture can be provided for passage of a power supply cable, e.g., a "pill-box" in the side of the furniture which opens directly below a worktop.

As already indicated, other inputs and outputs are either built into the furniture as part of the computer unit, or are coupled to the computer unit without the use of hard wiring. Thus, a touch sensitive pad may be built into the furniture, for example immediately below a desktop surface, and hard wired within the furniture to the computer; a mouse may communicate with the computer via radio, ultrasonic or infra-red radiation; a keyboard may be available, for example accommodated in a desk drawer, and hard wired within, or plugged into, the furniture; and coupling to an external printer may be by infra-red, for example.

The provision of a display is somewhat more problematic. Where appropriate to the furniture, it will be placed or mounted thereon, e.g. on a desk-top. Since it will also need power, it will normally be hard-wired for power to the furniture, and this wiring can be composite to additionally conduct the necessary information to the display (and therefrom, if appropriate, such has with a touch screen), or a wireless form of communication could be adopted. Ideally, the display is either concealable within the furniture, or removable therefrom, when the computer is not in use, so as to leave no sign that the furniture is or contains a computer. In one preferred form, the display is a flat screen display. As for the power supply, hard wire connection to the display could be, for example, via an aperture in a pedestal side immediately below a desk top, or via a plug and socket connection located behind a false movable or removable drawer front, or even via an aperture in a desk top, although this latter option is not preferred.

Preferably the item of furniture is arranged so that all parts of the computer unit contained therein, with the optional exception of a power supply cable, are concealed or concealable when the computer unit is not in use.

From another aspect, the invention provides a computer unit as herein defined having a casing made of wood or a wood substitute.

It will be understood that any or all of the above aspects may be combined.

The above aspects go a considerable way to preventing theft, by disguising the computer or computer system function, and/or by rendering the computer or computer system difficult to carry, since it is integrated into the furniture and not removable therefrom as a single unit, and/or by rendering access to the computer/CPU difficult. At the same time, the resulting product can be aesthetically pleasing and disadvantages associated with the interwiring of separate units (including reduced speed of operation) can be reduced or avoided entirely.

Embodiments of the invention are illustrated in the accompanying fixtures, in which.

DETAILED DESCRIPTION

Figure 1:
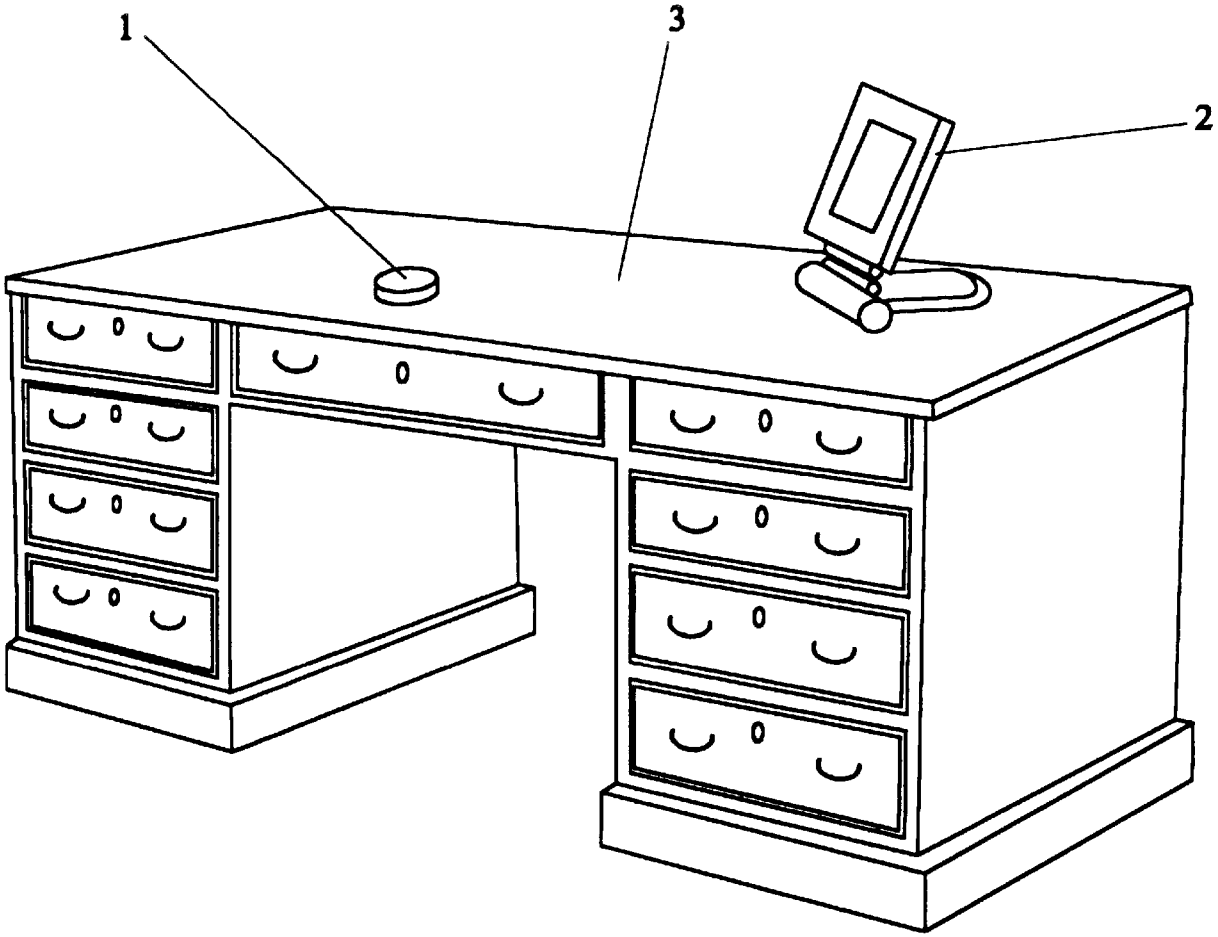
FIG. 1 shows a first embodiment or the invention, in the form of a wooden desk providing a personal computer with a wireless mouse and a display on its working surfaces.
Figure 2:
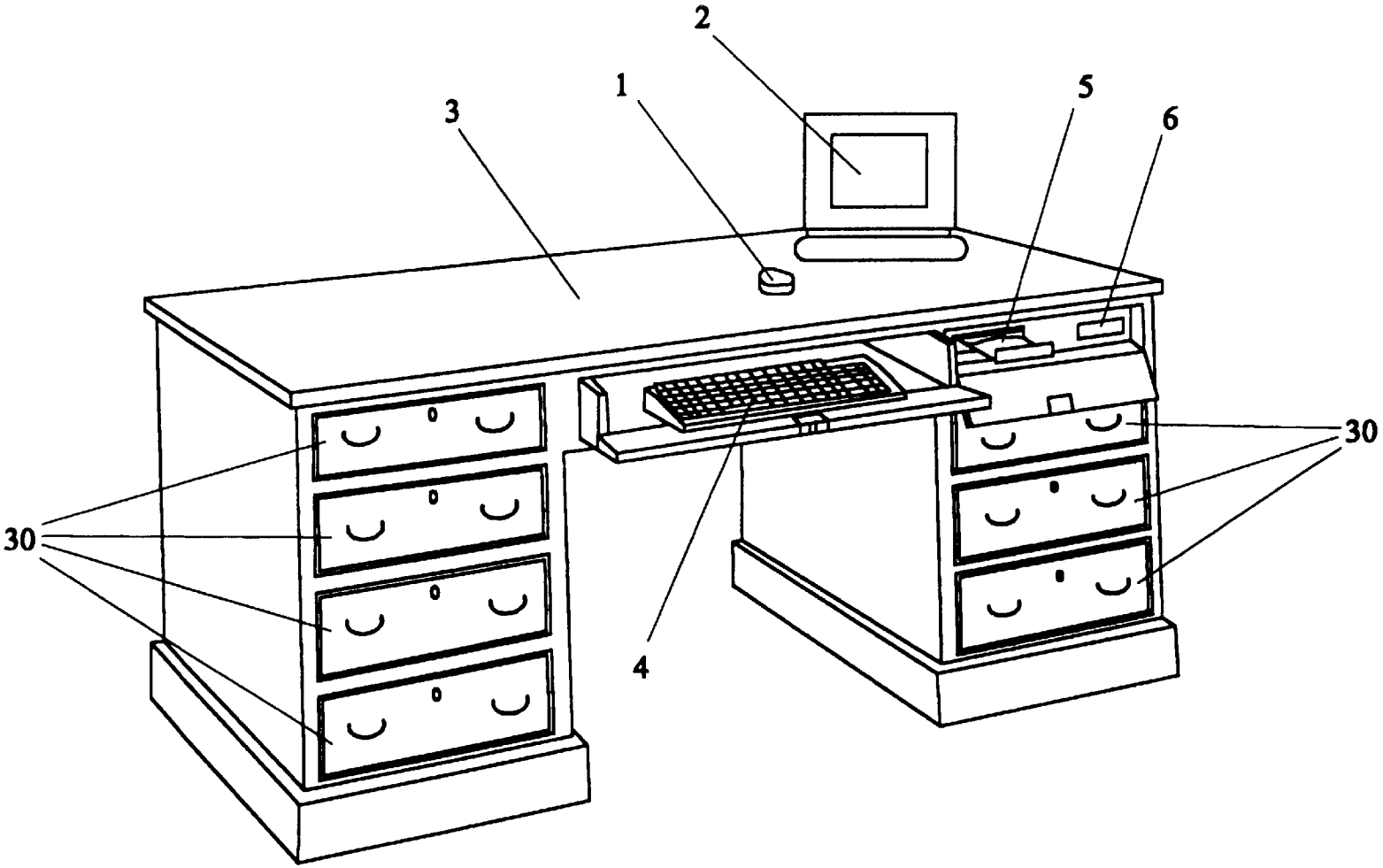
FIG. 2 shows the desk of FIG. 1 opened for access to a keyboard and disc port.

FIGS. 1 and 2 are general views of a wooden two pedestal partner's desk, the former in a closed position, and the latter showing input/output devices of a computer accessible for use. Ideally a mouse 1 and display 2 lying on the desk top 3 are both removable when not in use, so that there are no visible signs that a computer unit is present. The mouse communicates with a computer unit in the desk by infra-red. Communication from the desk to the display 2 could be by wireless means, for example inductive coupling, particularly if the display is self-powered, although inductive coupling could also be used for power transfer. More commonly, however, the display is hardwired to the desk to receive power and information therefrom, and, optionally, to transmit information thereto. A plug-in connection which can be concealed in known manner may be necessary for this purpose. Where the design permits, an effective manner of concealing a plug-in connector is to place it behind a movable or removable false drawer front, conveniently at the rear of the desk.

As shown in FIG. 2, the desk comprises computer input/output devices in the form of a keyboard 4, CD ROM port 5 and floppy disc port 6.

Figure 3:
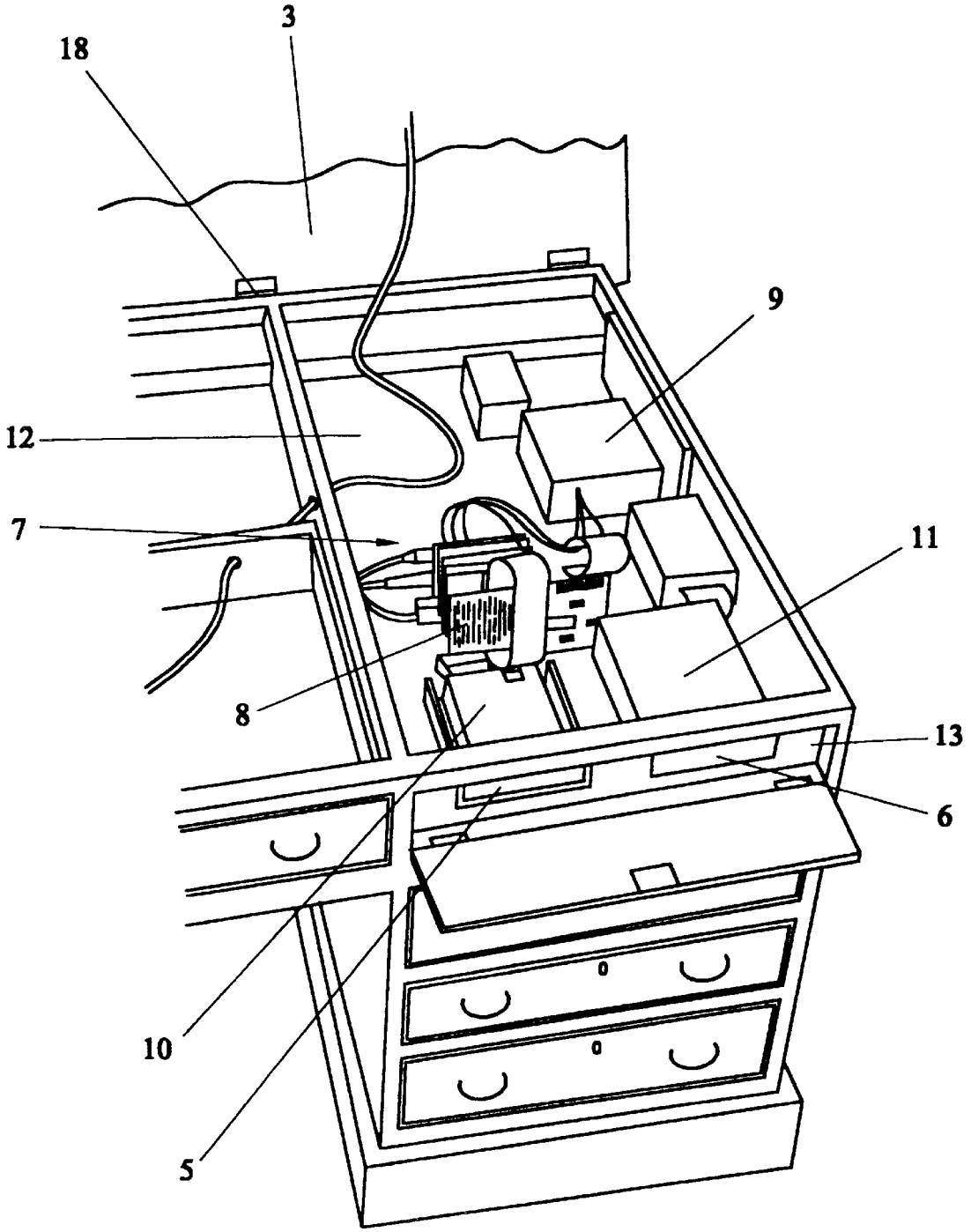
FIG. 3 shows a computer unit mounted in the desk of FIG. 1.
Figure 4:
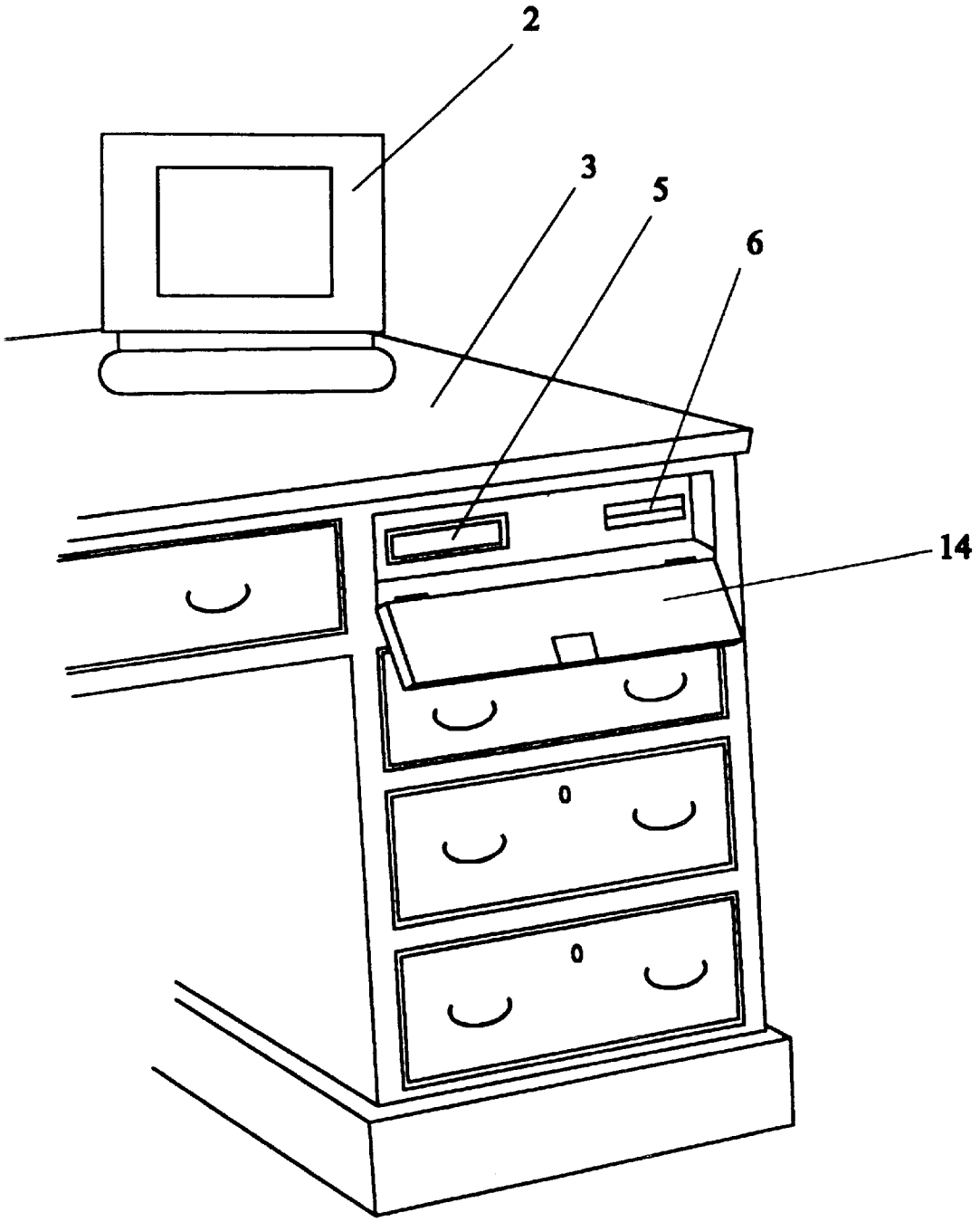
FIG. 4 shows more detail of ports for CD ROM and floppy disc drives, which are integrated in the desk of FIG. 1, behind a drop-down false drawer front.

FIG. 3 illustrates the siting of the computer unit 7 in a space under the desk-top 3 which would normally be occupied by a drawer. As shown, the computer unit 7 is composed of a number of different items, including a motherboard 8 with CPU and memory, power supply 9, a CD ROM drive 10 and a floppy disc drive 11, all of which would conventionally be built into a metal casing. At least some of these items are now separately assembled onto a wooden base 12 forming an integral part of the desk, while the ports 5, 6 and drives 10, 11 are built into a front panel 13. This panel and the ports are concealed by a lockable drop down false side drawer front 14 (FIG. 4), when the computer is not in use.

Figure 5:
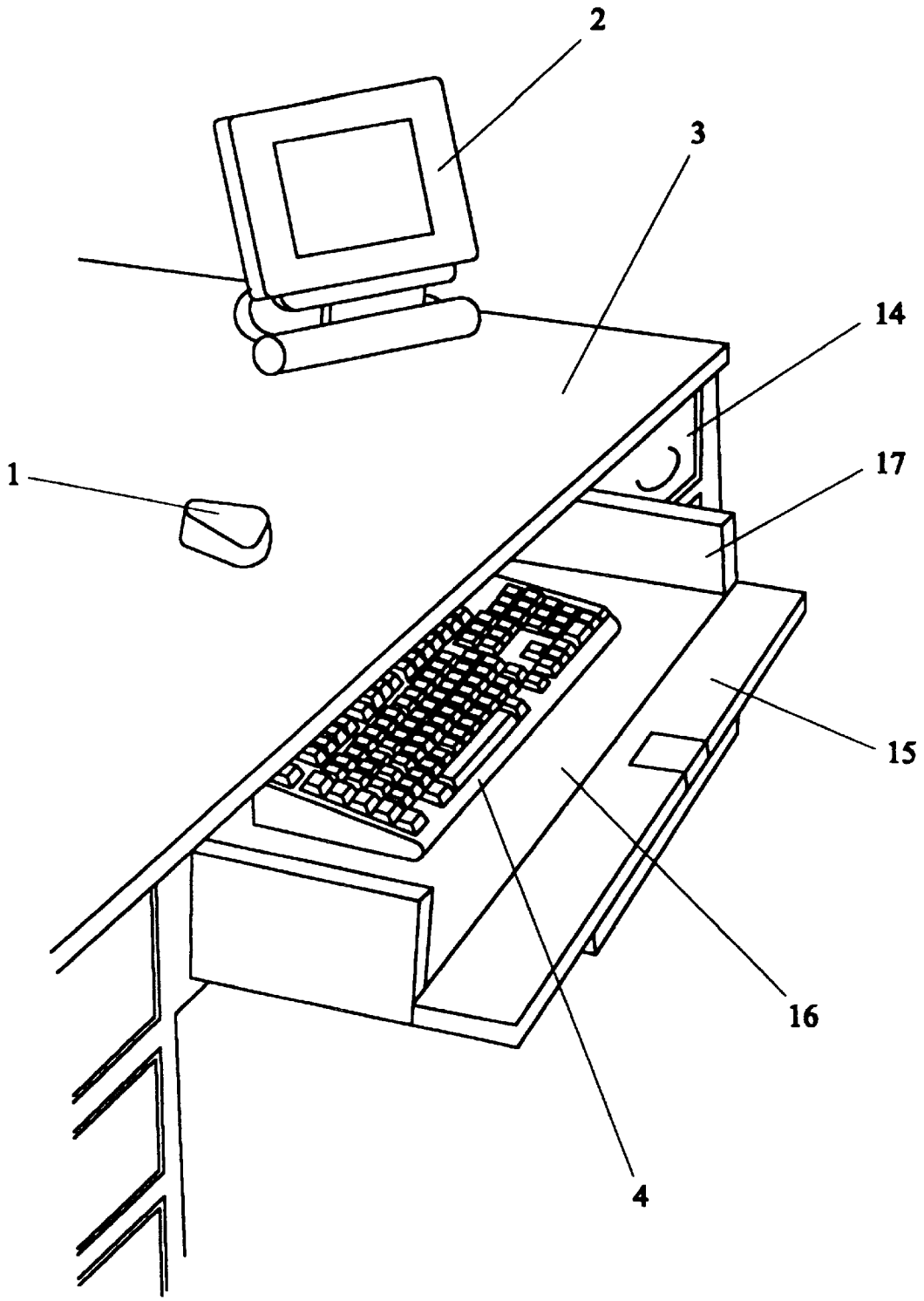
FIG. 5 shows the location of a keyboard within the desk of FIG. 1.

As shown in more detail in FIG. 5, a further lockable drop-down false central drawer front 15 covers a space containing the keyboard 4. Both false front 15 and keyboard 4 are mounted on a sliding shelf 16. The keyboard could be permanently fixed to the shelf 16 or removable or readily releasable therefrom (or from the space, if the shelf is not provided, or is not slidable) for placing on the desk-top 3.

If required, the sliding shelf could have sides 17, so as to form the carcase of a drawer when the false drawer front 15 is in position.

For ease of access to the CPU or computer unit, the whole desk-top 3 is hinged at the rear edge so that it can be raised, as in FIG. 3. Preferably, the desk-top 3 is normally securely fixed in the down position—for example it could be locked or held by a sliding bolt accessible only when one of the drawer fronts 14, 15 has been opened. Similarly the drawer fronts 14, 15 could be interlocked so that they can only be opened in a particular order. Preferably the whole desk top is substantially unbroken by apertures or joins, etc.

Other drawers 30 of the desk are available for normal use, although it would be possible to use the space behind a further false drawer front(s) to accommodate other parts of the computer, if necessary. The false fronts 14 and 15 are of similar appearance to the fronts of the real drawers, the heights of the false fronts 14 and 15 equate to that of the real drawer at the top of the left-hand pedestal, and the width of the false front 14 equates to that of the underlying real drawer fronts in the right hand pedestal.

Naturally, parts of the computer unit 7 not requiring physical access by the user could be sited elsewhere in the desk, for example on a vertical back panel, according to the user's requirements. Similarly, it would be possible to locate the false drawer front 14 and the computer components lying to its rear in another position consistent with the appearance and use of the desk.

Preferably a cooling fan is installed directly onto the main processor of the CPU. Cooling ducts may be installed as required, and/or vents provided internally between sections of the furniture or on an external furniture surface, preferably one which is not normally seen.

As illustrated, the display 2 is a flat panel display, but other displays, such as a CRT monitor could be used.

It would be possible to arrange for any of drawer fronts 14, 15 and the desk top 3 to be wholly removable, rather than hinged.

Figure 6:
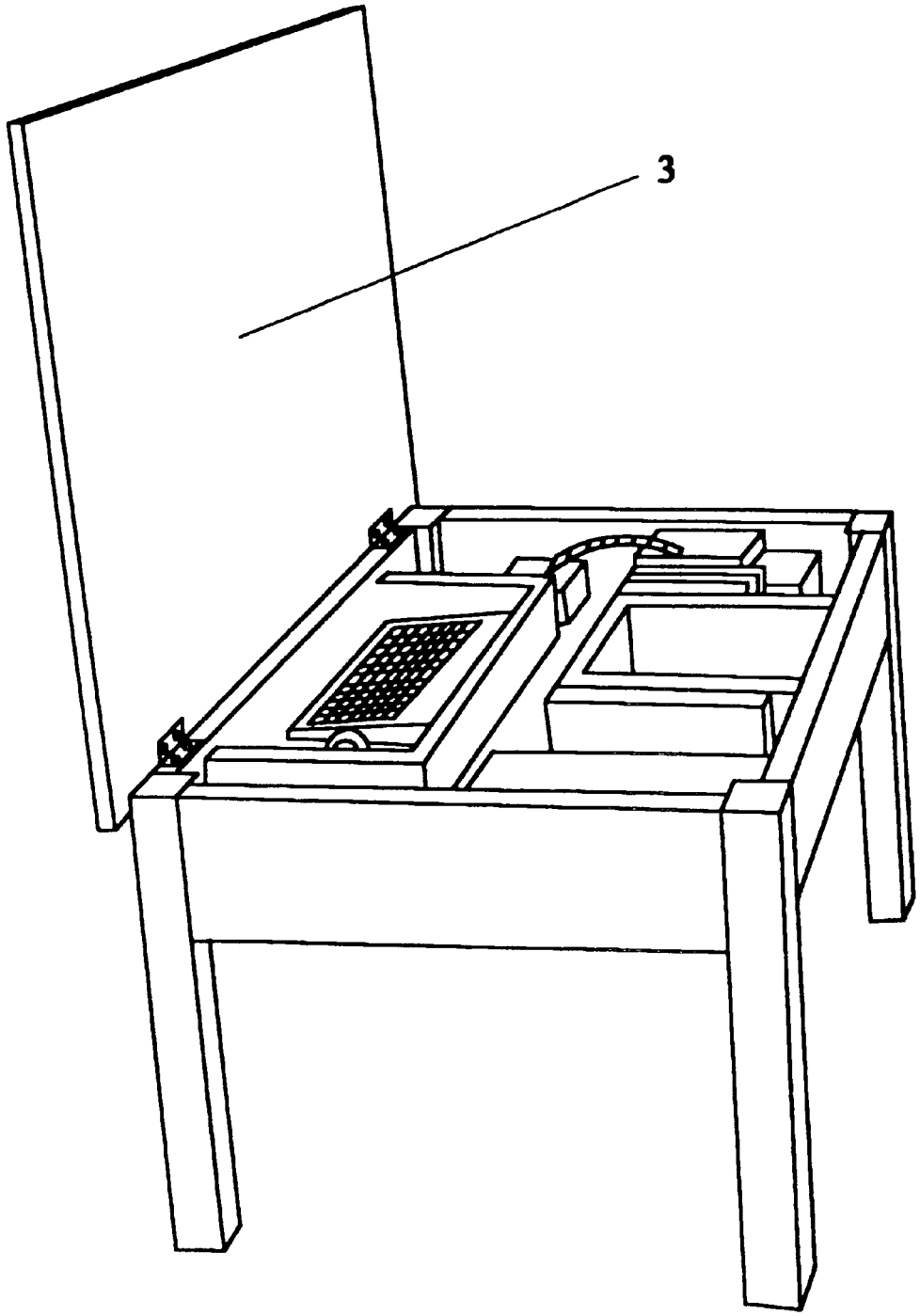
FIG. 6 shows a second embodiment of the invention, in the form of a writing table, opened for access to its interior.
Figure 7:
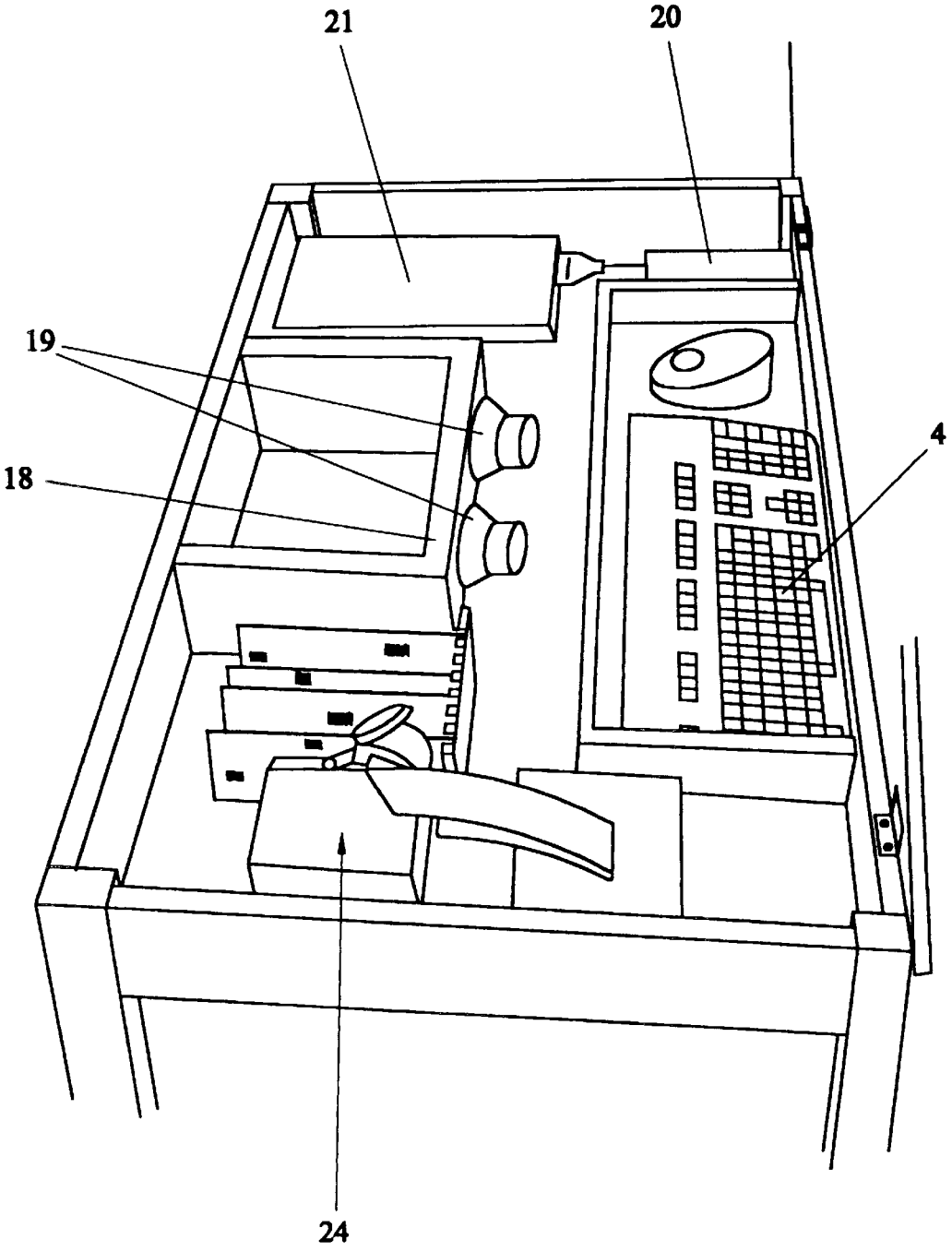
FIG. 7 shows another view of the table of FIG. 6.
Figure 8:
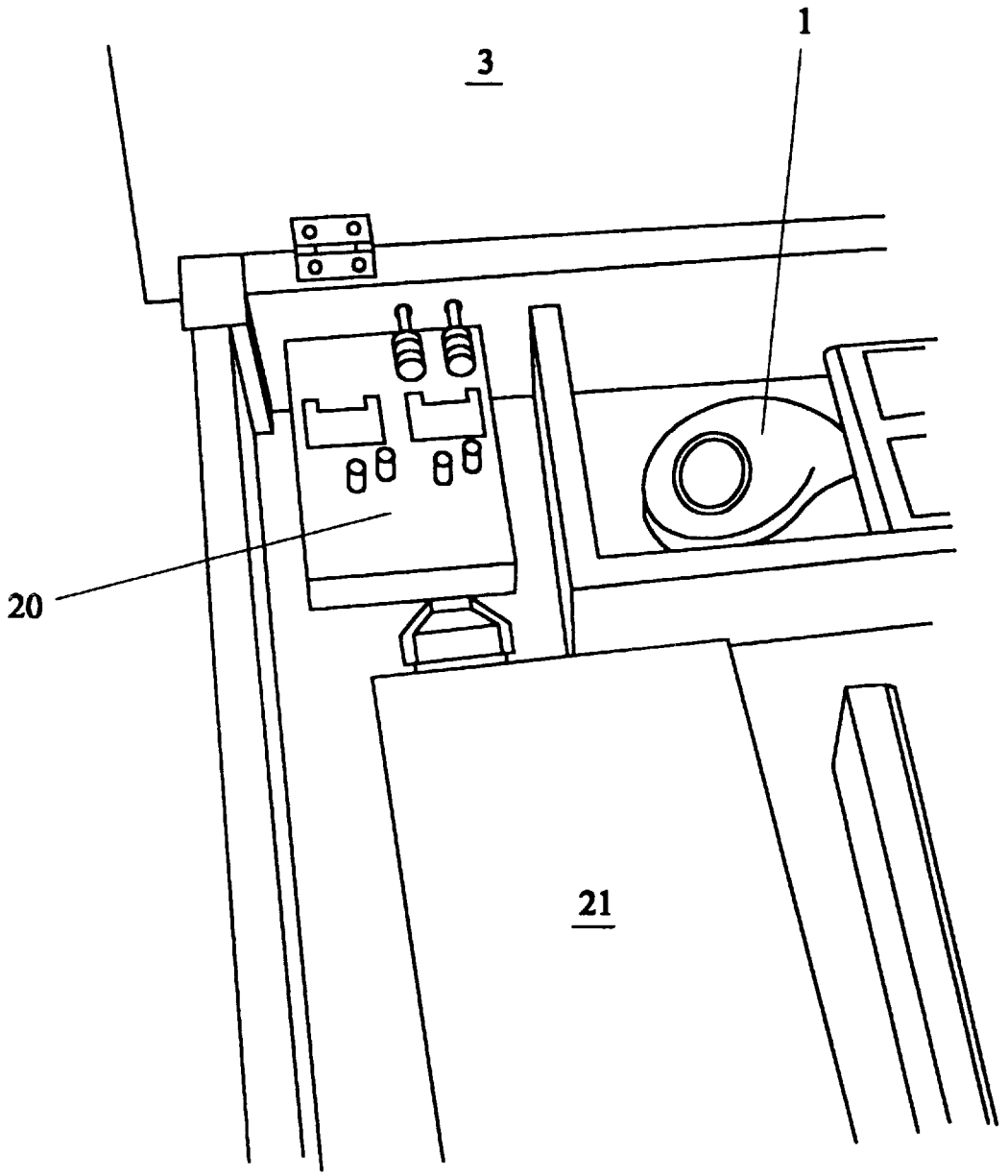
FIGS. 8 and 9 show further detail of the table of FIG. 6.

FIGS. 6 to 8 illustrate a second embodiment of the invention, in the from of a writing table. Like reference numbers are used for like or functionally similar parts.

As will be seen from FIG. 6, the table top 3 is hinged at its front edge to permit access to a volume which accommodates the computer unit. The keyboard is arranged in a space behind a central false drawer front (not shown) in an arrangement similar to that of FIG. 1. The volume beneath the table top is smaller than that of the desk of FIG. 1, and parts of the computer unit are distributed over a larger proportion thereof, including both sides of the space accommodating the keyboard 4.

In the particular embodiment shown, a major part 24 of the computer unit is accommodated to the left of the volume, at the side of, and behind, the keyboard space. At the rear center of the volume is located a mounting 18 which carries two loudspeakers 19, FIG. 7, and these are powered by an amplifier 20, FIG. 8, to the right of the keyboard space. A CD ROM changer 21 is mounted behind the amplifier.

Figure 9:
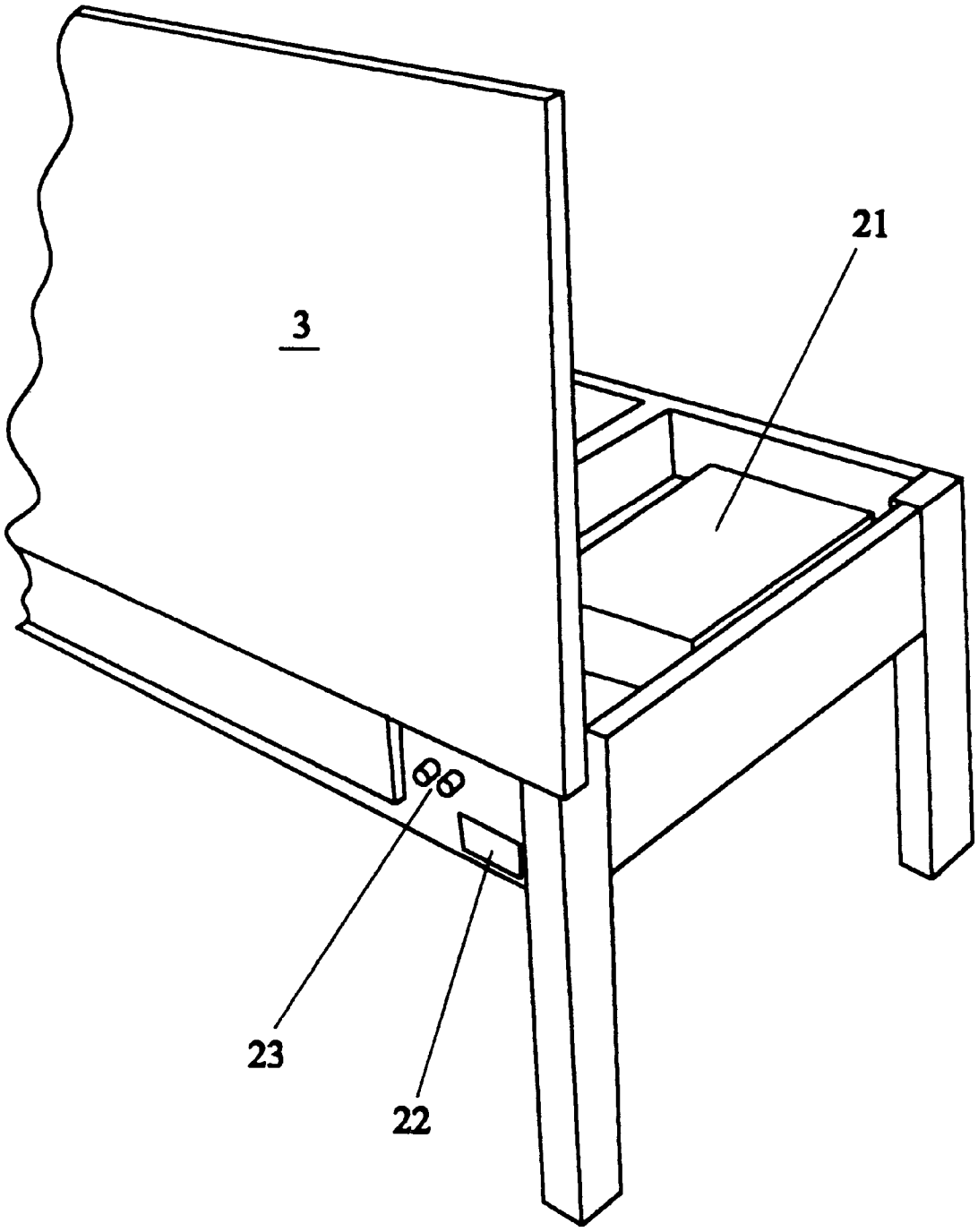

To the right of the central false drawer front are located a disc port and controls 23, e.g. for the amplifier 20, as shown in FIG. 9. If required, these may be concealable by a removable or hinged false drawer front, in a similar manner to the desk, and there may be a further left hand drawer front, either for a real drawer, or for concealment of other computer parts.

As in the desk, various parts of the computer unit, including a motherboard and memory, PSU, amplifier, CD ROM changer and speakers, are directly secured to the wood of the table itself, rather than through the intermediacy of a steel box.

The space for the keyboard also accommodates a mouse 1 when not in use, and a mounting may be provided below the base of the volume for storing a joystick, by its base, in inverted position (not shown).

Again, it would be possible to arrange for any false drawer fronts and/or the table top 3 to be wholly removable, rather than hinged.

Most preferably, all computer parts contained in the desk or table, with the optional exception of a power supply cable, are concealed or concealable when the computer unit is not in use.

While the foregoing sets out the preferred forms of this invention, the scope thereof is determined by the claims below.

I claim:

1. An item of furniture comprising a carcass, a CPU of a computer mounted within said carcass, external access means fixed to said carcass for coupling the CPU to the exterior of the furniture, and a false drawer front movable relative to or removable from said carcass for concealing said external access means.

2. An item of furniture according to claim 1 further comprising at least one slidable drawer which is slidable relative to the carcass of the furniture.

3. An item of furniture according to claim 2 wherein the computer comprises at least two physically separate operatively connected computer parts individually mounted to said carcass.

4. An item of furniture according to claim 3 further comprising a sliding shelf, and a sliding shelf false drawer front is attached to said sliding shelf for concealing contents of the sliding shelf.

5. An item of furniture of claim 4 wherein said sliding shelf false drawer front conceals a keyboard fixedly or removably mounted to said sliding shelf.

6. An item of furniture according to claim 5 wherein the sliding shelf false drawer front and a front of the slidable drawer have matching or similar external appearance.

7. An item of furniture according to claim 2 wherein the false drawer front and a front of the slidable drawer have matching or similar external appearance.

8. An item of furniture according to claim 2 comprising a work surface or essentially flat top surface which overlies and substantially closes a compartment for said CPU.

9. An item of furniture according to claim 2 wherein the false drawer front and a front of the slidable drawer have similar or matching appearance.

10. An item of furniture according to claim 2 further comprising a slidable shelf and a movable or removable drawer front attached to said sliding shelf or to said carcass for concealing contents on said shelf.

11. An item of furniture according to claim 1 wherein said external access means comprises at least one disc port.

12. An item of furniture according to claim 1 further comprising a work surface comprising an essentially flat top surface which overlies and substantially closes a compartment for said CPU.

13. An item of furniture according to claim 12 wherein said work surface is opaque and movable or removable for access to the compartment.

14. An item of furniture according to claim 12 wherein said work surface has a substantially continuous and unbroken appearance.

15. An item of furniture according to claim 12 wherein said work surface has a substantially continuous and unbroken appearance.

16. An item of furniture according to claim 12 wherein the computer unit comprises at least two physically separate operatively computer parts individually mounted to said carcass.

17. A desk or writing table comprising a carcass and at least one drawer slidable to said carcass, a CPU of a computer unit mounted within said carcass, external access means fixed to said carcass for coupling the CPU exterior to the furniture, and a false drawer front movable relative to or removable from said carcass for concealing said external access means.

18. A desk according to claim 17 wherein said carcass comprises at least one pedestal and said at least one drawer is slidable with said pedestal.

19. A desk according to claim 18 wherein said access means is fixed to said carcass above said pedestal.

20. A desk according to claim 19 further comprising a slidable shelf and a movable or removable drawer front attachable to said sliding shelf or to said carcass for concealing contents on said shelf.

21. A desk according to claim 20 wherein said slidable shelf is slidable in said carcass to one side of said pedestal.

22. A desk according to claim 18 further comprising a slidable shelf and a movable or removable drawer front attachable to said sliding shelf or to said carcass for concealing contents on said shelf.

23. A desk according to claim 17 further comprising a slidable shelf and a movable or removable drawer front attachable to said sliding shelf or to said carcass for concealing contents on said shelf.

24. A desk according to claim 17 further comprising a work surface which overlies and substantially closes a compartment for said CPU.

25. A desk according to claim 24 wherein said work surface has a substantially continuous and unbroken appearance.

26. A desk according to claim 25 wherein said work surface is movable or removable for access to the compartment.

27. A desk according to claim 24 wherein said work surface is movable or removable for access to the compartment.

28. A desk or writing table comprising a carcass, at least one drawer within said carcass, a CPU of a computer unit mounted within said carcass, at least one disc port fixed to said carcass for coupling the CPU to an exterior of the desk or writing table, and a false drawer front movable relative to or removable from said carcass for concealing said disc port.

29. A desk or writing table according to claim 28 further comprising a slidable shelf and a movable or removable drawer front attached to said sliding shelf or to said carcass for concealing contents on the shelf.

30. A desk or writing table according to claim 29 wherein said disc port is mounted to one side of said sliding shelf.

31. A desk or writing table according to claim 30 wherein said carcass comprises at least one pedestal and said disc port is mounted above said pedestal.

* * * * *

UNITED STATES PATENT AND TRADEMARK OFFICE

CERTIFICATE OF CORRECTION

PATENT NO. : 6,022,087
APPLICATION NO. : 09/059715
DATED : February 8, 2000
INVENTOR(S) : David Gilbert It is certified that error appears in the above-identified patent and that said Letters Patent is hereby corrected as shown below:

On the cover of the patent, please add the following paragraph:

[30] Foreign Application Priority Data

Oct. 13, 1995 [GB] 9520965.6
Oct. 10, 1996 [US] PCT 02477/96

At the top of column 1, please add the following:

This application is the national phase nder 35 U.S.C. § 371 of PCT International Application No. PCT/GB96/02477 which has an International filing date of October 10, 1996, which designated the United States of America, which claims priority from Great Britain application number 9520965.6, filed October 13, 1995.

Signed and Sealed this

Twenty-fourth Day of October, 2006

JON W. DUDAS
*Director of the United States Patent and Trademark Office*